US006713730B1

(12) United States Patent
Zakerin

(10) Patent No.: US 6,713,730 B1
(45) Date of Patent: Mar. 30, 2004

(54) TIMING SYSTEM

(76) Inventor: Zahra M. Zakerin, 1240 14th Ave. # 105, San Francisco, CA (US) 94122

( * ) Notice: Subject to any disclaimer, the term of this patent is extended or adjusted under 35 U.S.C. 154(b) by 216 days.

(21) Appl. No.: 09/952,859

(22) Filed: Sep. 14, 2001

(51) Int. Cl.[7] ..... H05B 1/02
(52) U.S. Cl. ..... 219/492; 219/494
(58) Field of Search ..... 219/414, 486, 219/492, 445.1, 448.12, 489, 490, 494, 493, 481, 506, 519, 396, 397, 398, 411; 126/200, 39 BA; 340/309.9, 310.08, 500, 501, 635, 660, 640

(56) References Cited

U.S. PATENT DOCUMENTS

| | | | | |
|---|---|---|---|---|
| 3,610,753 A | | 10/1971 | Neubauer | |
| 3,889,091 A | | 6/1975 | Ishikawa | |
| 3,909,565 A | | 9/1975 | Clouser et al. | |
| 4,341,197 A | * | 7/1982 | Butts | 126/39 BA |
| 4,636,621 A | | 1/1987 | Mc George | |
| 4,782,420 A | | 11/1988 | Holdgaard-Jensen | |
| 5,289,158 A | * | 2/1994 | Neves | 340/309.9 |
| 5,796,346 A | * | 8/1998 | Wash et al. | 340/635 |
| D420,245 S | | 2/2000 | De'Longhi | |
| 6,140,620 A | * | 10/2000 | Aldridge et al. | 219/493 |
| 6,570,135 B2 | * | 5/2003 | Gros et al. | 219/396 |
| 2002/0113062 A1 | * | 8/2002 | Cranford | 219/518 |

FOREIGN PATENT DOCUMENTS

| | | | |
|---|---|---|---|
| WO | WO 9900629 A1 * | 1/1999 | F24C/15/12 |

* cited by examiner

*Primary Examiner*—Tu Ba Hoang

(57) ABSTRACT

A timing system includes a control member being operationally coupled to a heat-emitting device of the oven and a heat-emitting device of each of the burners for turning the heat-emitting devices on or off. A temperature selection member is operationally coupled to the control. A plurality of heat level selection members is operationally coupled to the control member for selectively choosing a desired relative heat level for each of the burners. A plurality of timing members is operationally coupled to the control member for selectively turning the heat-emitting devices off after a pre-selected amount of elapsed time. Each of the timing members is associated with one of the heat-emitting devices. The selected heating emitting device may be turned on for a selected amount of time by the timing member and are turned off by the timing member when the selected amount of time is expired.

8 Claims, 2 Drawing Sheets

TIMING SYSTEM

BACKGROUND OF THE INVENTION

1. Field of the Invention

The present invention relates to timing systems and more particularly pertains to a new timing system for allowing a user to prevent damage, injuries, and even deaths related to electric ranges.

2. Description of the Prior Art

The use of timing systems is known in the prior art. U.S. Pat. No. 3,909,565 describes a device/system for setting the time that an oven is to start and stop heating. Another type of timing systems is U.S. Pat. No. 4,782,420 having an automatic safety switch apparatus for interrupting power to an electrical appliance.

While these devices fulfill their respective, particular objectives and requirements, the need remains for a system that is superior to the above mentioned and has certain improved features. A new invention is needed to fulfill the need of being able to control the level of heat provided as well as the duration of time needed to an appliance.

SUMMARY OF THE INVENTION

The present invention meets the needs presented above by allowing a user to adjust the temperature and duration of time for both the oven and the heating elements located on the appliance top.

Still yet another object of the present invention is to provide a new timing system that would prevent waste of energy and food.

Even still another object of the present invention is to provide a new timing system that would also prevent young, unattended children from being injured as a consequence of playing with the controls of the appliance, inadvertently turning it on, and being buried by contact with its heating elements or related surfaces.

To this, the present invention generally comprises a control means that is operationally coupled to a heat-emitting device of the oven and a heat-emitting device of each of the burners for turning the heat-emitting devices on or off. A temperature selection means is operationally coupled to the control. A plurality of heat level selection means is operationally coupled to the control means for selectively choosing a desired relative heat level for each of the burners. A plurality of timing means is operationally coupled to the control means for selectively turning the heat-emitting devices off after a pre-selected amount of elapsed time. Each of the timing means is associated with one of the heat-emitting devices. The selected heating emitting device may be turned on for a selected amount of time by the timing means and are turned off by the timing means when the selected amount of time is expired.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
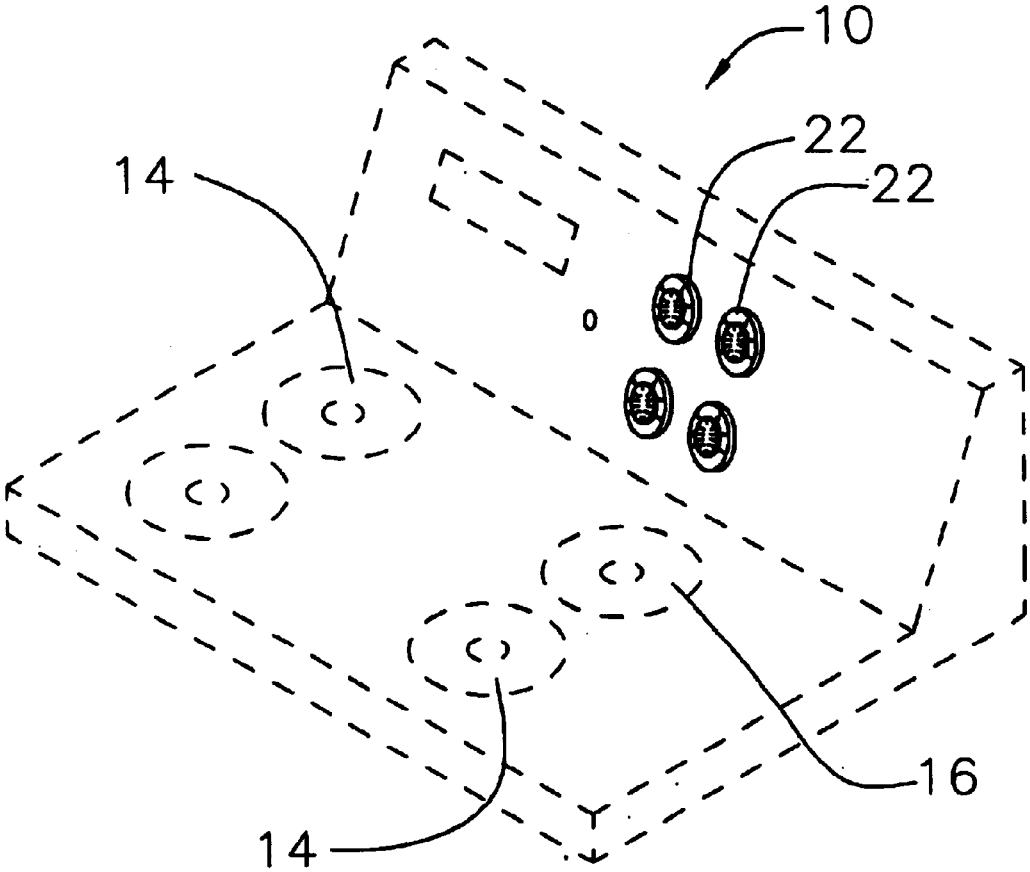
FIG. 1 is a perspective view of a new timing system according to the present invention.
Figure 2:
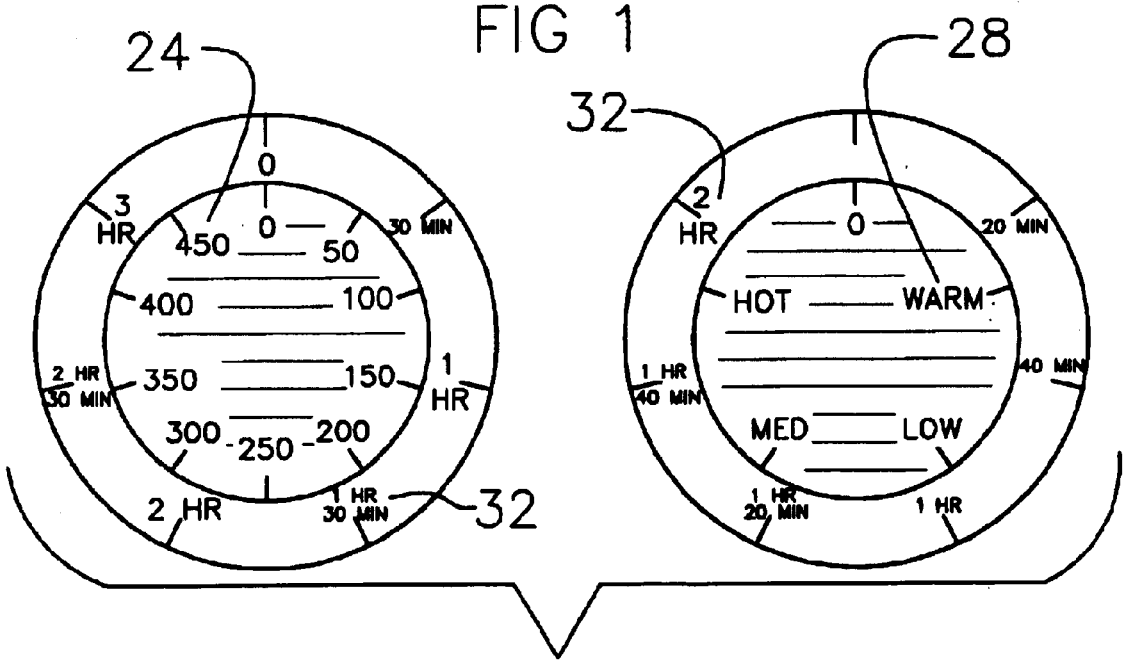
FIG. 2 is a front view of the present invention.
Figure 3:
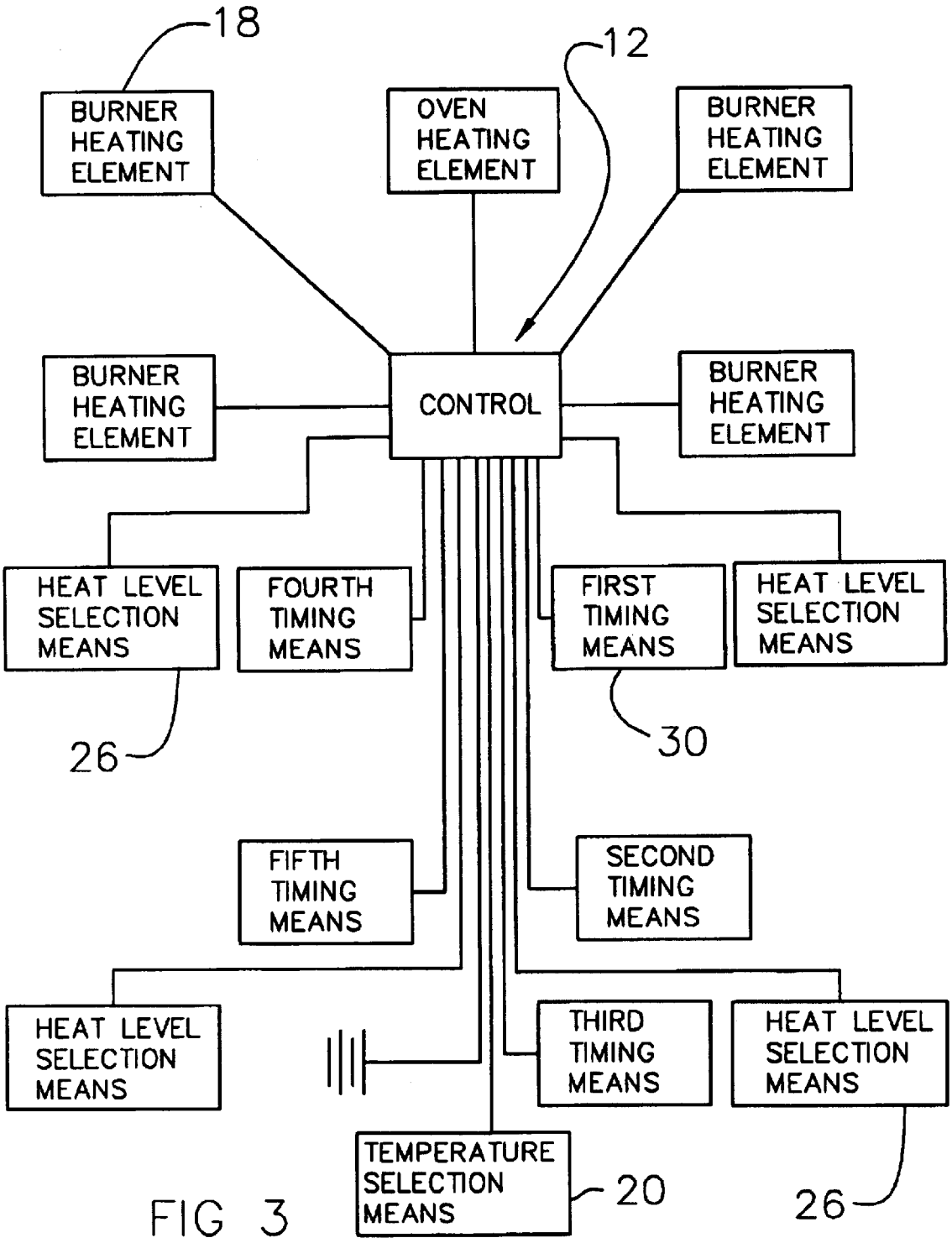
FIG. 3 is schematic view of the present invention.

With reference now to the drawings, and in particular to FIGS. 1 through 3 thereof, a new timing system embodying the principles and concepts of the present invention and generally designated by the reference numeral 10 will be described.

As best illustrated in FIGS. 1 through 3, the timing system 10 generally includes a control means 12 that is operationally coupled to a heat-emitting device 14 of the oven and a heatemitting device 14 of each of the burners 16 for turning the heat-emitting devices 14 on or off, each of the heat-emitting devices 14 includes at least one heating element 18. The control means could consist of either an electronic or electro mechanical control.

A temperature selection means 30 is operationally coupled to the control means 12 for selectively choosing a desired temperature of the oven. The temperature selection means 30 includes a dial 22 rotatably mounted on the stove and has temperature indicia 24 positioned thereon. The temperature selection means could consist of either an electronic or electro mechanical control.

A plurality of heat level selection means 26 is operationally coupled to the control means 12 for selectively choosing a desired relative heat level for each of the burners 16. Each of the heat level selection means 26 includes a dial 22 rotatably mounted on the stove and has heat level indicia 28 thereon.

A plurality of timing means 30 is operationally coupled to the control means 12 for selectively turning the heat-emitting devices 14 off after a pre-selected amount of elapsed time. Each of the timing means 30 is associated with one of the heat-emitting devices 14. Each of the timing means 30 includes a dial 22 that is rotatably coupled to the stove and has a plurality of time indicia 32 positioned thereon. A first of the timing means 30 is associated with the oven and includes a dial 22 rotatably couple to the stove.

The time indicia 32 on the first timing means 30 are selected from times that extend from zero minutes to 3 hours. Each of the timing means 30 associated with one of the burners 16 has timing indicia 32 thereon selected from times extending from zero minutes to 2 hours. The selected heating emitting device 14 may be turned on for a selected amount of time by the timing means 30 and are turned off by the timing means 30 when the selected amount of time is expired.

In use, the timer regulated controls of the present invention could prevent fires caused by and individual forgetting to shut this type of appliance off after use or as a result of becoming distracted during the course of preparing a meal. This feature could also help prevent the waste of energy, as well as food.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A timing system for a stove having an oven and a plurality of burners, comprising:

a control means being operationally coupled to a heat-emitting device of the oven and a heat-emitting device of each of the burners for turning the heat-emitting devices on or off;

a temperature selection means being operationally coupled to said control means for selectively choosing a desired temperature of said oven;

a plurality of heat level selection means being operationally coupled to said control means for selectively choosing a desired relative heat level for each of said burners;

a plurality of timing means being operationally coupled to said control means for selectively turning said heat-emitting devices off after a pre-selected amount of elapsed time, each of said timing means being associated with one of said heat-emitting devices; and wherein the selected heat-emitting device is turned on for a selected amount of time by said timing means and are turned off by said timing means when said selected amount of time is expired.

2. The timing system as in claim 1, wherein each of said beat-emitting devices comprises at least one heating element.

3. The timing system as in claim 1, wherein said temperature selection means includes a dial rotatably mounted on the stove and having temperature indicia positioned thereon.

4. The timing system as in claim 3, wherein each of said heat level selection means includes a dial rotatably mounted on the stove and having heat level indicia thereon.

5. The timing system as in claim 1, wherein each of said timing means includes a dial rotatably coupled to said stove and having a plurality of a plurality of time indicia positioned thereon.

6. The timing system as in claim 5, wherein a first of said timing means being associated with the oven and including a dial rotatably couple to the stove, said time indicia on said first timing means being selected from times extending from zero minutes to 3 hours, each of said timing means associated with one of said burners having timing indicia thereon selected from times extending from zero minutes to 2 hours.

7. The timing system as in claim 3, wherein each of said timing means includes a dial rotatably coupled to said stove and having a plurality of a plurality of time indicia positioned thereon.

8. A timing system for a stove having an oven and a plurality of burners, comprising:

a control means being operationally coupled to a heat-emitting device of the oven and a heat-emitting device of each of the burners for turning the heat-emitting devices on or off, each of said heat-emitting devices comprising at least one heating element;

a temperature selection means being operationally coupled to said control means for selectively choosing a desired temperature of said oven, said temperature selection means including a dial rotatably mounted on the stove and having temperature indicia positioned thereon;

a plurality of heat level selection means being operationally coupled to said control means for selectively choosing a desired relative heat level for each of said burners, each of said heat level selection means including a dial rotatably mounted on the stove and having heat level indicia thereon;

a plurality of timing means being operationally coupled to said control means for selectively turning said heat-emitting devices off after a pre-selected amount of elapsed time, each of said timing means being associated with one of said heat-emitting devices, each of said timing means including a dial rotatably coupled to said stove and having a plurality of a plurality of time indicia positioned thereon, a first of said timing means being associated with the oven and including a dial rotatably couple to the stove, said time indicia on said first timing means being selected from times extending from zero minutes to 3 hours, each of said timing means associated with one of said burners having timing indicia thereon selected from times extending from zero minutes to 2 hours; and wherein the selected heat-emitting device is turned on for a selected amount of time by said timing means and are turned off by said timing means when said selected amount of time is expired.

* * * * *